United States Patent [19]

Urataki et al.

[11] Patent Number: 5,041,765

[45] Date of Patent: Aug. 20, 1991

[54] NEGATIVE GLOW DISCHARGE LAMP DEVICE

[75] Inventors: Etsuo Urataki; Masayoshi Kodama, both of Tokyo; Hiromitsu Matsuno, Hachioji, all of Japan

[73] Assignee: Hitachi, Ltd., Tokyo, Japan

[21] Appl. No.: 321,069

[22] Filed: Mar. 9, 1989

Related U.S. Application Data

[63] Continuation-in-part of Ser. No. 126,789, Nov. 30, 1987, Pat. No. 4,879,493.

[30] Foreign Application Priority Data

Dec. 2, 1986 [JP] Japan ..... 61-285853
Mar. 11, 1988 [JP] Japan ..... 63-56057

[51] Int. Cl.[5] ..... H05B 41/18
[52] U.S. Cl. ..... 315/200 R; 315/59; 315/326; 315/358
[58] Field of Search ..... 315/33, 50, 56, 58, 315/59, 200 R, 205, 207, 326, 358, DIG. 7, 99; 313/310, 317, 318, 619, 620, 634, 642, 641, 639, 637, 638

[56] References Cited

U.S. PATENT DOCUMENTS 4,001,637 1/1977 Gray ..... 315/247 X
4,879,493 11/1989 Matsuno et al. ..... 313/641

FOREIGN PATENT DOCUMENTS 57-180967 of 0000 Japan .
63-19750 1/1988 Japan .

*Primary Examiner*—David Mis
*Attorney, Agent, or Firm*—Fay, Sharpe, Beall, Fagan, Minnich & McKee

[57] ABSTRACT

A negative glow discharge lamp device has a discharge container enclosing at least a rare gas, a hot cathode disposed in the discharge container and coated with a thermion radiation matter, and an anode located in a negative glow domain formed between the anode and the hot cathode in the discharge container, a power conversion circuit for driving the lamp device includes a rectifier directly connected at its d.c. output terminals to the hot cathode and the anode respectively for supplying d.c. electric power to the discharge container, and a capacitor ballast connected between a power supply terminal of an a.c. power source and an a.c. input terminal of the rectifier for controlling discharge current in the discharge container.

28 Claims, 1 Drawing Sheet

NEGATIVE GLOW DISCHARGE LAMP DEVICE

BACKGROUND OF THE INVENTION

The present application is a continuation-in-part of U.S. Pat. No. 4,879,493 issued Nov. 7, 1989 from copending application Ser. No. 126,789 filed Nov. 30, 1987.

1. Field of the Invention

This invention relates to a light emitting device, and more particularly to a lighting device which is suitable for improving the stability of electrical characteristics and broadening the applicable frequency range of an electric discharge lamp of small size.

2. Description of the Related Art

JP-A-57-180967 (Japanese Utility Model Publication Laid-open No. 57-180967) discloses a lamp lighting device which includes a d.c. power source in the form of a battery, and a ballast in the form of a resistor. Also, JP-A-63-19750 discloses a low voltage electric discharge lamp of small size having at least one pair of electrodes and a discharging gas enclosed in a tightly formed discharge container. The disclosed discharge lamp employs an electrode arrangement in which, when one of the electrodes acts as an anode, the electrode acting as the anode is located in a negative glow domain so as to ensure zero anode drop voltage. The disclosure describes that, because of the employment of the electrode arrangement described above, both the lamp voltage and the discharge starting voltage of the low voltage electric discharge lamp of small size can be lowered to increase the luminous efficiency of the discharge lamp, so that the lamp can operate with high efficiency.

For such a type discharge lamp, U.S. Pat. No. 4,879,493 may be referred to which is entitled "Low-pressure discharge lamp" and filed by Matsuno et al. on Nov. 30, 1987 in favor of Hitachi, Ltd. The inventors of the present invention disclose a means for preventing undesirable degradation of the operating characteristics of such a lamp due to occurrence of graphitization in U.S. patent application Ser. No. 321,066 entitled "Negative Glow Discharge Lamp", filed Mar. 9, 1989 in favor of Hitachi, Ltd.

However, the lamp lighting device of the type using the d.c. power source as the lighting power supply and including a resistor as the ballast for stabilizing the lamp current is disadvantageous in that power consumption and generation of heat at the resistor ballast are quite large, resulting in a very low overall efficiency of the device.

The low voltage electric discharge lamp of the type being energized by an a.c. power source is also disadvantageous as described below. In the first place, due to the presence of two hot cathodes, thermion radiation matter coated on the hot cathodes is scattered in an amount two times as large as when a single hot cathode is provided, resulting in undesirable degradation of the operation characteristics of the discharge lamp. Secondly, because the two hot cathodes alternately operate as the anode, the hot cathode operating in the anode ON cycle is heated by electric power of an amount corresponding to the product of the lamp current and the work function of the electrode. Therefore, when the lamp current is subjected to variation due to variation of the power source voltage, variation of the power source frequency, variation of the characteristics of a ballast, etc., the electrode heating condition varies greatly, resulting in an undesirable increase in the amount of the scattered thermion radiation matter. Because of the defects pointed out above, application of, for example, the same ballast under a power source frequency of 50 Hz and under a power source frequency of 60 Hz is impossible.

SUMMARY OF THE INVENTION

It is an object of the present invention to provide a negative glow discharge lamp device of small size which can be used to operate with a voltage supplied from an a.c. power source, which exhibits high circuit efficiency, which can be maintained stable against variation of the power source voltage, and which can be operated at 50 Hz or at 60 Hz.

The above object of the present invention is attained by provision of a lamp lighting device including a ballast in the form of a capacitor and a rectifier circuit for converting an a.c. voltage into a d.c. voltage and by employment of a lamp electrode arrangement in which a single anode is combined with a single hot cathode.

That is, the present invention provides a negative glow discharge lamp device of small size comprising a discharge container enclosing at least a rare gas, a hot cathode disposed in the discharge container and coated with a thermion radiation matter, an anode located in a negative glow domain formed between the anode and the hot cathode in the discharge container, a rectifier connected at its d.c. output terminals to the hot cathode and the anode respectively for supplying d.c. electric power to the discharging container, and a capacitor ballast connected between a power supply terminal of an a.c. power source and an a.c. input terminal of the rectifier for controlling discharge current in the discharge container.

Thus, according to the negative glow discharge lamp device of the present invention using the capacitor as the ballast, the circuit efficiency is remarkably higher than that of the foregoing device using a resistor ballast, and the voltage variation characteristic is improved over that of a conventional device using a choke coil ballast. Further, by the provision of the rectifier, an electrode acting exclusively as an anode can be used in the discharge lamp, so that lamp operation characteristics are not adversely affected by variation of the lamp current. Therefore, the negative glow discharge lamp device of small size according to the present invention can operate with high efficiency regardless of whether it is connected to an a.c. power source of 50 Hz or an a.c. power source of 60 Hz.

Further, in an embodiment of the present invention, a starting device in the form of a nonlinear semiconductor switch is provided in the lamp base so that the lamp can be made very compact in size and structure.

DETAILED DESCRIPTION OF THE PREFERRED EMBODIMENTS

Figure 1:
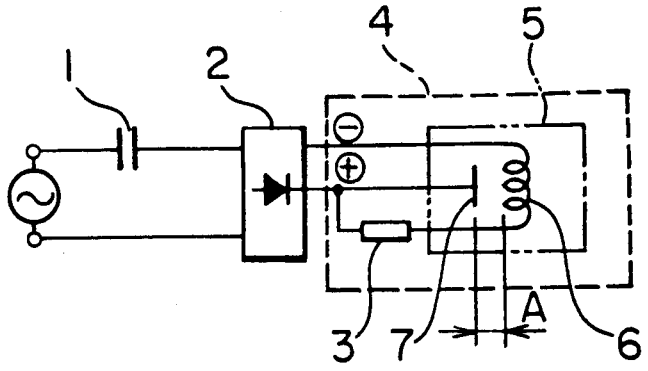
FIG. 1 is a circuit diagram showing schematically the structure of an embodiment of the negative glow discharge lamp device according to the present invention.

The principle of the present invention will be first described before describing the present invention in detail, so that the present invention can be more clearly understood. As described already, a known low voltage electric discharge lamp of small size having at least one pair of electrodes and a discharging gas enclosed in a tightly formed discharge container is featured by employment of an electrode arrangement in which, when one of the electrodes acts as an anode, the electrode acting as the anode is located in a negative glow domain. In such a low voltage electric discharge lamp, the lamp voltage is generally equal to the metastable excitation voltage of the rare gas and is quite lower than the lamp voltage of, for example, an ordinary fluorescent lamp. In the ordinary fluorescent lamp, a change in the lamp voltage due to variation of the lamp current shows a so-called negative characteristic, and an increase in the lamp current results in a decrease in the lamp voltage. On the other hand, in the case of a low voltage electric discharge lamp as characterized by the present invention, a change in the lamp current does not cause any appreciable change in the lamp voltage as will be described later.

In the negative glow discharge lamp device of the present invention, a capacitor used as a ballast, which is a lamp current control element, is combined with a low voltage electric discharge lamp having a feature as described above. Thus, even when the voltage of an a.c. power source may greatly vary, the voltage applied across the discharge lamp, that is, the lamp voltage is relatively low or only about 9 V which is almost negligible when compared to the power source voltage of 100 V. Therefore, the value of the lamp current is substantially determined by the capacitance value of the capacitor ballast. Also, since the lamp voltage-lamp current characteristic remains substantially flat even when the power source voltage may vary, the rate of lamp current variation is merely proportional to the rate of variation of the power source voltage from the rated value. In the case of a device comprising the combination of a choke coil ballast and a fluorescent lamp, variation of the voltage-current characteristic of the ballast itself and variation of the voltage-current characteristic of the fluorescent lamp itself attributable to variation of the power source voltage must be taken into consideration. In the case of the discharge lamp device of the present invention, however, such consideration is utterly unnecessary, and the lamp current characteristic can be made very stable.

Further, because a rectifier is provided in the lighting power supply circuit so as to convert an a.c. voltage into a d.c. voltage, the low voltage electric discharge lamp can employ an electrode arrangement including a single hot cathode and a single anode. In this electrode arrangement, the anode acts merely to scavenge electrons, obviating the need for thermion radiation matter coating. The shape of the anode can be freely selected, and a metal strip, rod, wire or the like which scatters hegligibly can be used to form the anode. Therefore, even when the temperature of the anode changes due to variation of the lamp current, the anode substance scatters negligibly, thereby improving the operation characteristics of the discharge lamp.

Furthermore, the discharge lamp device including the capacitor ballast can operate with high efficiency without any electric loss. Also, because the capacitor used as the ballast is free from the saturation characteristic afflicting the choke coil, the use of the capacitor ballast is advantageous in that the lamp current varies only slightly even when the power source voltage varies considerably.

In the discharge lamp device of the present invention in which a rectifier is provided to convert an a.c. voltage into a d.c. voltage as described above, the low voltage electric discharge lamp can employ an electrode arrangement in which a single anode and a single hot cathode are combined, as also described above. The material and shape of the anode can be freely selected so that the anode substance negligibly scatters even when the lamp current changes.

Preferred embodiments of the present invention will now be described in detail with reference to the drawings.

FIG. 1 is a circuit diagram showing schematically the structure of an embodiment of the negative glow discharge lamp device according to the present invention. Referring to FIG. 1, the discharge lamp device comprises a capacitor 1 functioning as a ballast, a rectifier 2, a starting device 3, and a discharge lamp 4. The lamp 4 contains therein a hot cathode 6 formed by a filament or the like, and an anode 7 formed by a metal rod or strip. A light emitting section 5 of the lamp 4 is made of a glass or the like, and a phosphor is coated on the inner wall surface of the glass. Alternatively, the light emitting section 5 of the lamp 4 may be made of, for example, a glass permeable to ultraviolet rays, with no coating provided on the inner wall surface of the glass. Further, the light emitting section 5 of the lamp 4 is maintained gastight, and a rare gas such as argon is enclosed together with mercury in the light emitting section 5 of the lamp 4 so that ultraviolet rays can be properly radiated. The distance A between the anode 7 and the hot cathode 6 is selected to be equal to or less than 10 mm, that is, to satisfy the relation $0<A\leqq 10$ mm, so that the anode 7 can be located in a negative glow domain.

In the discharge lamp device shown in FIG. 1, the discharge container of the light emitting section 5 of the lamp 4 was made of an ultraviolet-ray transmitting glass having an outer diameter of 15 mm and a length of 45 mm, the hot cathode 6 was formed by a tungsten coil coated with a thermion radiation matter consisting or made essentially of (Ba, Sr, Ca) O, the anode 7 was formed by a nickel strip, and the distance A between the anode 7 and the hot cathode 6 was set at 3 mm. Argon at 5 Torr was enclosed together with mercury in the discharge container. The capacitor 1 had a capacitance of 10 $\mu$F, the rectifier 2 was a full-wave rectifier, and the discharge lamp device was connected to an a.c. power source having a power source voltage of 100 V and a frequency of 50 Hz.

Figure 2:
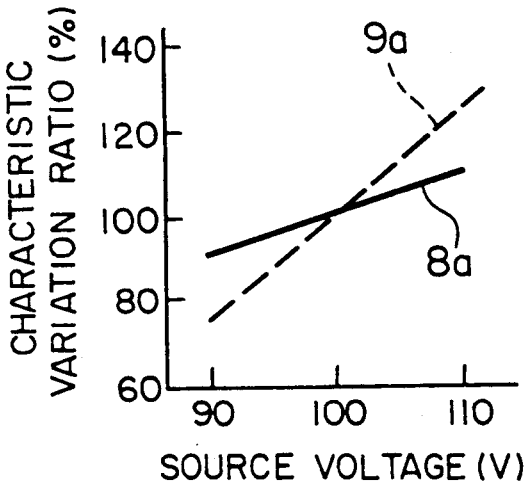
FIG. 2 is a voltage variation characteristic diagram of the device shown in FIG. 1.

FIG. 2 shows the results of measurement of the lamp current variation characteristic of the discharge lamp device having the structure shown in FIG. 1 relative to variation of the power source voltage. That is, FIG. 2 shows the results of measurement of the voltage variation characteristic of the discharge lamp device. The solid curve 8*a* in FIG. 2 represents the lamp current variation characteristic of the discharge lamp device of the present invention. Although the lamp current variation ratio was about 10% when the power source voltage was increased by about 10%, such a lamp current variation ratio is quite slight and does not pose any practical problem. On the other hand, in the case of a comparative discharge lamp device in which the capacitor ballast 1 employed in the present invention was replaced by a conventional resistor ballast, generation of heat and power consumption at the resistor were large, and a voltage as high as about 90 V was applied across the resistor when the a.c. power source voltage was 100 V. As a result, the luminous efficiency was very low, that is, the ratio between the quantity of luminescence and the input power was very small as shown in Table 1 described later. Therefore, such a discharge lamp device is hardly suitable for practical application.

The broken curve 9a shown in FIG. 2 represents the lamp current variation characteristic of another comparative discharge lamp device in which the capacitor ballast 1 employed in the present invention was replaced by a conventional choke coil ballast. It will be seen from comparison between the curves 9a and 8a that the lamp current variation ratio in the comparative discharge lamp device is significantly larger than that of the discharge lamp device of the present invention. This is because the choke coil itself has such a nonlinear voltage-current characteristic that the current increases sharply in a high voltage range. It will also be seen from Table 1 described later that the discharge lamp device using the choke coil ballast is also disadvantageous in that, because the power consumption due to the resistive component of the ballast is large, a larger input power supply for the device is required, resulting in lowered luminous efficiency.

Figure 3:
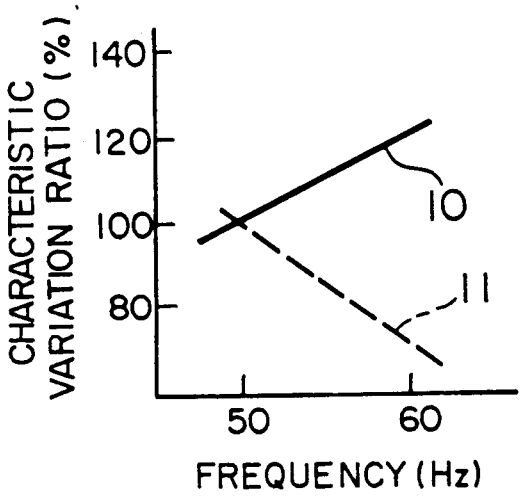
FIG. 3 is a frequency variation characteristic diagram of the device shown in FIG. 1.

FIG. 3 shows the results of measurement of the lamp current variation characteristic when the power source frequency was changed from 50 Hz to 60 Hz. The solid curve 10 in FIG. 3 represents the lamp current variation characteristic of the discharge lamp device of the present invention in which the capacitor ballast 1 is used. It will be seen that the lamp current variation ratio in such a case is about 20% which lies in a sufficiently practically allowable range. Therefore, the desired long useful service life can be ensured. On the other hand, in the case of the comparative discharge lamp device using the conventional choke coil ballast, a lamp current variation ratio of more than 30% was observed as shown by the broken curve 11 in FIG. 3 when the power source frequency was changed from 50 Hz to 60 Hz. Therefore, it is practically difficult to use such a discharge lamp device at both 50 Hz and 60 Hz. Furthermore, since the lamp 4 includes a hot cathode 6 similar to that used in an ordinary fluorescent lamp, such a sharp decrease in the lamp current results in a greatly shortened useful service life of the lamp 4 in the discharge lamp device, thereby greatly degrading the commercial value of the product.

The electrode arrangement including the single anode 7 and the single hot cathode 6 could be provided by the use of the capacitor 1 acting as the ballast and by the provision of the rectifier 2 converting the a.c. voltage into the d.c. voltage. The anode 7 was formed by the strip or rod of nickel having a substance scattering tendency less than that of a thermion radiation coating such as (Ba, Sr, Ca)O. Therefore, any appreciable scattering of the anode substance of the anode 7 did not occur, and the discharge lamp device could operate with satisfactory operation characteristics regardless of a change in the lamp current due to variation of the power source voltage or frequency.

Figure 4:
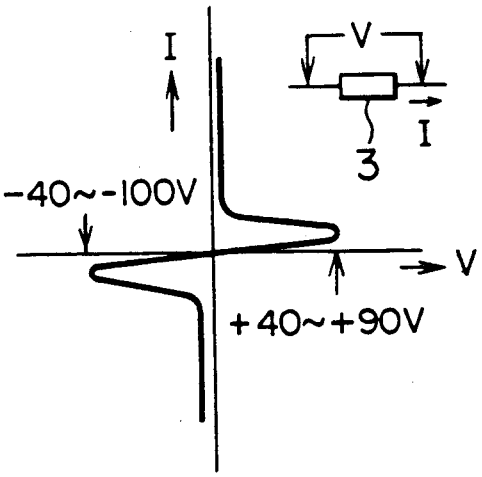
FIG. 4 is a voltage-current characteristic diagram of the starting device shown in FIG. 1.

In the discharge lamp device of the present invention, a nonlinear semiconductor switch having a voltage-current characteristic as shown in FIG. 4 is used as the lamp starting device 3 which is connected at the position shown in FIG. 1. It will be seen in FIG. 4 that, when the voltage applied across the nonlinear semiconductor switch exceeds a predetermined limit or threshold, the resistance across the nonlinear semiconductor switch decreases sharply to permit flow of a large current. Because this nonlinear semiconductor switch is small in size, it can be located in the base among various component parts of the lamp 4 so that the size of the lamp 4 can be made small.

When the power source voltage applied to the lamp 4 in the discharge lamp device of the present invention was 100 V, the capacitance of the capacitor 1 was set at about 10 μF. The lamp voltage was 9 V, the lamp current was 0.35 A, the input power supplied to the device was about 3.5 W, and the power consumption of the ballast was about 0.5 W, as shown in Table 1. Thus, the discharge lamp of small size could operate with high efficiency.

TABLE 1

| | Lamp current (A) | Device input power (W) | Ballast power consumption (W) | Lamp power (W) |
|---|---|---|---|---|
| Capacitor ballast | 0.35 | 3.5 | 0.5 | 3 |
| Resistor ballast | 0.35 | 33 | 30 | 3 |
| Choke coil ballast | 0.35 | 7 | 4 | 3 |

Figure 5:
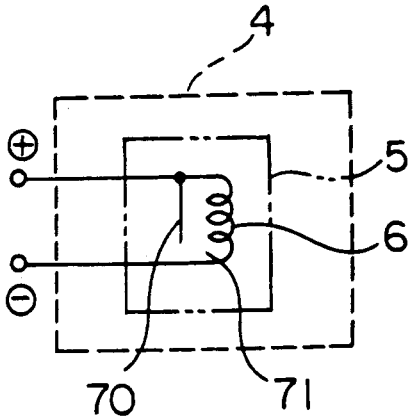
FIG. 5 shows schematically the structure of a modification of the lamp in another embodiment of the present invention.

FIG. 5 shows another form of the discharge lamp 4. Referring to FIG. 5, an anode 70 is electrically connected to one end of the hot cathode 6 and extends substantially in parallel to the hot cathode 6. The discharge starting device 3 is eliminated in FIG. 5. The power source voltage is applied to the light emitting section 5 of the lamp 4 through the capacitor ballast 1 and the rectifier 2 to heat the hot cathode 6. As the temperature of the hot cathode 6 rises, the electrical resistance of the hot cathode 6 increases. Therefore, the voltage difference between the anode 70 and the other end 71 (not connected to anode 70) of the hot cathode 6 increases to cause an electrical discharge between the anode 70 and the other end 71 of the hot cathode 6. This embodiment of the present invention including the discharge lamp 4 shown in FIG. 5 is advantageous in that the discharge starting device is unnecessary, and the size of the discharge lamp 4 can thus be reduced even further.

We claim:

1. A negative glow discharge lamp device, comprising:

a negative glow discharge lamp including a discharge container enclosing at least a rare gas, a hot cathode disposed in said discharge container and coated with a thermion radiation matter, an anode located in a negative glow domain formed between said anode and said hot cathode in said discharge container; and power conversion means for converting an a.c. power signal to a d.c. power signal for delivery to the negative glow discharge lamp, the negative glow discharge lamp thereby being capable of providing substantially flicker-free light output, said power conversion means including a full-wave rectifier having two a.c. input terminals and two d.c. output terminals, the full-wave rectifier being directly connected at its d.c. output terminals to a first end of said hot cathode and said anode respectively for supplying d.c. electric power to said discharge container, and a capacitor ballast connected between the a.c. power source and one a.c. input terminal of said rectifier for controlling discharge current in said discharge container.

2. A negative glow discharge lamp device according to claim 1, wherein a starting device is connected between said hot cathode and said anode to start electric discharge in said discharge container.

3. A negative glow discharge lamp device according to claim 1, wherein said anode is a strip of nickel.

4. A negative glow discharge lamp device according to claim 2, further comprising a lamp base mounted on one end of said discharge container.

5. A negative glow discharge lamp device according to claim 4, wherein said starting device is a nonlinear semiconductor switch.

6. A negative glow discharge lamp device according to claim 1, wherein mercury is enclosed together with said rare gas in said discharge container, and said discharge container comprises an ultraviolet-ray transmitting glass enclosure.

7. A negative glow discharge lamp device according to claim 1, wherein mercury is enclosed together with said rare gas in said discharge container, and a phosphor is coated on the inner wall surface of said discharge container.

8. A negative glow discharge lamp device according to claim 1, wherein said anode is an anode plate, and said cathode is a cathode coil.

9. A negative glow discharge lamp device according to claim 1, further comprising a lamp base mounted at one end of said discharge container.

10. A negative glow discharge lamp device, comprising:

a negative glow discharge lamp including a discharge container enclosing at least a rare gas, a hot cathode disposed in said discharge container and coated with a thermion radiation matter, an anode located in a negative glow domain formed between said anode and said hot cathode in said discharge container; and power conversion means for converting an a.c. power signal to a d.c. power signal for delivery to the negative glow discharge lamp, the negative glow discharge lamp thereby being capable of providing substantially flicker-free light output, said power conversion means including a full-wave rectifier having two a.c. input terminals and two d.c. output terminals, the full-wave rectifier being connected at its d.c. output terminals to a first end of said hot cathode and said anode respectively for supplying d.c. electric power to said discharge container, and a capacitor ballast connected between the a.c. power source and one a.c. input terminal of said rectifier for controlling discharge current in said discharge container, wherein no additional filter is located between the rectifier and the negative glow discharge lamp device to produce said substantially flicker-free light output.

11. A negative glow discharge lamp device according to claim 10, further comprising a lamp base mounted at one end of said discharge container.

12. A negative glow discharge lamp device according to claim 10, wherein said anode is an anode plate, and said cathode is a cathode coil.

13. A negative glow discharge lamp device according to claim 10, wherein said anode is a strip of nickel.

14. A negative glow discharge lamp device according to claim 10, wherein a starting device is connected between said hot cathode and said anode to start electric discharge in said discharge container.

15. A negative glow discharge lamp device according to claim 14, further comprising a lamp base mounted on one end of said discharge container.

16. A negative glow discharge lamp device according to claim 14, wherein said starting device is a nonlinear semiconductor switch.

17. A negative glow discharge lamp device according to claim 10, wherein mercury is enclosed together with said rare gas in said discharge container, and said discharge container comprises an ultraviolet-ray transmitting glass enclosure.

18. A negative glow discharge lamp device according to claim 10, wherein mercury is enclosed together with said rare gas in said discharge container, and a phosphor is coated on the inner wall surface of said discharge container.

19. A negative glow discharge lamp device according to claim 10, wherein the d.c. output terminals of the rectifier are directly electrically connected to the cathode and anode, respectively.

20. A negative glow discharge lamp device, comprising:

a negative glow discharge lamp including a discharge container enclosing at least a rare gas, a hot cathode disposed in said discharge container and coated with a thermion radiation matter, an anode located in a negative glow domain formed between said anode and said hot cathode in said discharge container; and power conversion means for converting an a.c. power signal to a d.c. power signal for delivery to the negative glow discharge lamp with no additional discrete filter for filtering line transients, the negative glow discharge lamp thereby being capable of providing substantially flicker-free light output, said power conversion means including a full-wave rectifier having two a.c. input terminals and two d.c. output terminals, the full-wave rectifier being connected at its d.c. output terminals to a first end of said hot cathode and said anode respectively for supplying d.c. electric power to said discharge container, and a capacitor ballast connected between the a.c. power source and one a.c. input terminal of said rectifier for controlling discharge current in said discharge container.

21. A negative glow discharge lamp device according to claim 20, further comprising a lamp base mounted at one end of said discharge container.

22. A negative glow discharge lamp device according to claim 20, wherein said anode is an anode plate, and said cathode is a cathode coil.

23. A negative glow discharge lamp device according to claim 20, wherein said anode is a strip of nickel.

24. A negative glow discharge lamp device according to claim 20, including a starting device which is a nonlinear semiconductor switch.

25. A negative glow discharge lamp device according to claim 20, wherein mercury is enclosed together with said rare gas in said discharge container, and said discharge container comprises an ultraviolet-ray transmitting glass enclosure.

26. A negative glow discharge lamp device according to claim 20, wherein mercury is enclosed together with said rare gas in said discharge container, and a phosphor is coated on the inner wall surface of said discharge container.

27. A negative glow discharge lamp device according to claim 20, wherein the d.c. output terminals of the rectifier are directly electrically connected to the cathode and anode, respectively.

28. A negative glow discharge lamp device comprising a discharge container enclosing at least rare gas, a hot cathode coil disposed in said discharge container and coated with a thermion radiation matter, an anode plate located in a negative glow domain formed between said anode plate and said hot cathode coil in said discharge container, a rectifier connected at its d.c. output terminals to said hot cathode coil and said anode plate respectively for supplying d.c. electric power to said discharge container, and a capacitor ballast connected between a power supply terminal of an a.c. power source and an a.c. input terminal of said rectifier for controlling discharge current in said discharge container.

* * * * *